US008544469B2

(12) United States Patent
Howie

(10) Patent No.: US 8,544,469 B2
(45) Date of Patent: Oct. 1, 2013

(54) LOW PROFILE FILTER RESPIRATOR

(76) Inventor: Robin Middlemass Howie, Edinburgh (GB)

( * ) Notice: Subject to any disclaimer, the term of this patent is extended or adjusted under 35 U.S.C. 154(b) by 238 days.

(21) Appl. No.: 12/680,040

(22) PCT Filed: Sep. 26, 2008

(86) PCT No.: PCT/US2008/011190
§ 371 (c)(1),
(2), (4) Date: Mar. 25, 2010

(87) PCT Pub. No.: WO2009/042208
PCT Pub. Date: Apr. 2, 2009

(65) Prior Publication Data

US 2010/0199995 A1 Aug. 12, 2010

(30) Foreign Application Priority Data

Sep. 26, 2007 (GB) ..... 0718794.1

(51) Int. Cl.

| | |
|---|---|
| ***A62B 18/08*** | (2006.01) |
| ***A62B 19/00*** | (2006.01) |
| ***A62B 7/10*** | (2006.01) |
| ***A62B 23/02*** | (2006.01) |

(52) U.S. Cl.
USPC ..... 128/206.17; 128/206.15; 128/206.12; 128/201.25

(58) Field of Classification Search
USPC 128/201.25, 201.28, 205.12, 205.27–205.29, 128/206.12, 206.15–206.19
See application file for complete search history.

(56) References Cited

U.S. PATENT DOCUMENTS

| | | | | |
|---|---|---|---|---|
| 4,850,346 | A | 7/1989 | Michel et al. | |
| 4,934,361 | A | 6/1990 | Michel et al. | |
| 5,394,867 | A | 3/1995 | Swann | |
| 5,669,375 | A * | 9/1997 | Dahrendorf et al. | 128/206.17 |
| 5,782,234 | A | 7/1998 | Bates | |
| 5,797,974 | A * | 8/1998 | Flaherty et al. | 55/482 |
| 5,875,775 | A * | 3/1999 | Nur et al. | 128/201.28 |
| 5,937,856 | A | 8/1999 | Jonasson et al. | |
| 6,701,925 | B1 | 3/2004 | Resnick | |
| 7,523,750 | B2 * | 4/2009 | Krzysztofik | 128/201.25 |
| 2003/0029454 | A1 | 2/2003 | Gelinas et al. | |
| 2004/0003810 | A1 * | 1/2004 | Templeton et al. | 128/201.22 |
| 2006/0201511 | A1 * | 9/2006 | Freriks et al. | 128/205.29 |

FOREIGN PATENT DOCUMENTS

| | | |
|---|---|---|
| GB | 1051054 | 12/1966 |
| WO | 2004066764 A2 | 8/2004 |

OTHER PUBLICATIONS

International Search Report from related PCT Application No. PCT/GB2011/050111.
International Search Report from related PCT Application No. PCT/US2008/011190.
R. M. Howie, "Performance Requirements for a Light-Weight Filter Self-Rescue Device," presentation, Yokohama 2004 ISRP Conference, 2004.
R. M. Howie, "Performance Requirements for a Light-Weight Filter Self-Rescue Device," presentation abstract, Yokohama 2004 ISRP Conference, 2004.

* cited by examiner

*Primary Examiner* — Kristen Matter
(74) *Attorney, Agent, or Firm* — Thomas Y. Kendrick; Benesch, Friedlander, Coplan & Aronoff LLP

(57) ABSTRACT

A respiratory protective device in which a face piece (11) is located within the volume of a filter canister (10). The filter canister (10) can be in the form of a hollow section or sections which fit around all or part of the face piece (11) or on either side thereof. Contaminated air that has been purified in the filter canister (10) is ducted in an airtight manner through a hollow assembly (18) into the face piece (11).

4 Claims, 7 Drawing Sheets

LOW PROFILE FILTER RESPIRATOR

BACKGROUND OF THE INVENTION

1. Field of the Invention

The present invention relates generally to personal protective equipment and in particular to a personal respirator having a filter for filtering air during breathing.

2. Description of the Related Art

A filter of a conventional reusable filter respirator is generally in the form of a cylindrical canister in which impure air is drawn axially through the canister. The canister is generally connected to the face piece by a suitable connection device. Such connection device may incorporate an inhalation valve. Some respirators may be fitted with two or more filter canisters to increase the absorptive capacity of the filter system and to reduce the inhalation resistance. The overall depth of a complete respirator fitted with a single filter is therefore the sum of the depth of the canister, the depth of the connection device and the depth of the face piece. In a conventional half-face piece respirator fitted with a gas and vapor filter, the overall depth of the canister can be in the region of 50-75 mm and the overall depth of the complete filter respirator can be in the region of 100-120 mm.

This depth has a number of disadvantages: the center of gravity of the filter is a significant distance from the wearer's face, and therefore imposes a load on the wearer's neck muscles; the center of gravity of the filter is a significant distance from the center of rotation of the wearer's head (which is effectively above the spine), and therefore imposes a resistance to rotation, or cessation of rotation, of the wearer's head in both the horizontal and vertical planes; 3) the location of the center of gravity imposes a significant second moment of inertia, with the consequence that movement of the wearer's body can cause the respirator to "wobble" on the face, therefore affecting the efficiency of the seal between the respirator face piece; and, the respirator has significant bulk.

Where the respirator is intended for self-rescue from emergency situations, the bulk of a conventional respirator can result in a device which cannot conveniently be carried on the person; and may therefore not be available in an emergency situation when required. Also, if a large number of respirators have to be stored in case of emergencies, for example in a railway or underground carriage or subway, the bulk of a large number of stored respirators could affect passenger capacity and/or luggage capacity.

To provide protection in any emergency situation where a filter device for self-rescue could be used, i.e. a situation where oxygen deficiency is unlikely, a suitable device must be available to the person needing to escape. In setting performance requirements for a low-profile filter respirator for self-rescue it is therefore necessary to strike a balance between device weight and size on one hand and performance on the other so that it is likely that a suitable device will be available when required: if a device is too heavy or too bulky to carried on the person, in a handbag or briefcase, or too bulky to be stored in large numbers in public places such as schools, theatres or transport vehicles, it is unlikely to be available when required. A device that will protect all anticipated wearers under all foreseeable use situations may be so heavy and bulky that it is unlikely to be available: such a device may also be so complex to fit and wear that it may not be used correctly in an emergency situation. It may therefore be impracticable to attempt to provide adequate protection for all persons in all possible usage situations.

It is therefore considered that the performance requirements for a low-profile filter respirator for self rescue for use in non-occupational situations should be such that a complying device can be conveniently carried on the person, in a handbag or briefcase or securely stored in sufficient numbers in public places so as to be available when required.

It is considered that devices complying with EN 403 or DIN 58647-7 are likely to be too bulky and too heavy to meet the above criterion. For example, devices complying with either standard are permitted to weigh up to 1 kg.

The bulk and weight of devices incorporating gas filters essentially depend on the weight of the gas filter. For a given filter technology, filter weight can only be reduced by reducing the mass of absorbent/adsorbent and therefore reducing the mass of contaminant able to be retained by the filter.

Standard tests of gas filter capacity are based on test gas challenge concentrations which are intended to provide a relatively short test period, and thus a relatively inexpensive test, rather than on an assumption that the test gas challenge concentration will be experienced in practice in foreseeable use situations. For example, in EN 141 the minimum breakthrough period for a B1 filter is 25 minutes in a challenge concentration of 1,000 ppm of hydrogen cyanide. If it were assumed that the absolute capacity of a B1 filter does not change with challenge concentration, it is simpler and cheaper to test a filter at 1,000 ppm for 25 minutes rather than to test the same filter at 25 ppm for 1,000 minutes. This test is therefore not based on the assumption that a wearer of such a device is likely to be exposed to 1,000 ppm of hydrogen cyanide for 25 minutes. EN 141 states "The minimum breakthrough time is intended only for laboratory tests under standardized conditions. It does not give an indication of the possible service time in practical use"

It is therefore possible to design low mass gas filters for single use devices by specifying filter performance in terms of challenge concentrations to which the device is likely to be exposed over foreseeable self-rescue durations.

SUMMARY OF THE INVENTION

The present invention provides an apparatus for filtering breathing air for personal use that in a preferred embodiment provides a respirator filter and face piece with a substantially reduced bulk and lower moment of inertia during wear.

Such reduction can be achieved by manufacturing the filter canister in the form of a hollow cylinder, a U-shape, or other suitable shape in which impure air is drawn radially through the filter and where respirator components and/or the face piece and/or the wearer's facial components, such as the nose and/or chin, are located within the hollow filter canister.

A low-profile filter respirator is provided for use in escape situations is to reduce the overall bulk of the respirator filter and face-piece by wrapping the filter canister body around the face-piece rather than having it extend beyond the face-piece as in conventional respirators.

DETAILED DESCRIPTION OF THE PREFERRED EMBODIMENTS

Figure 1:
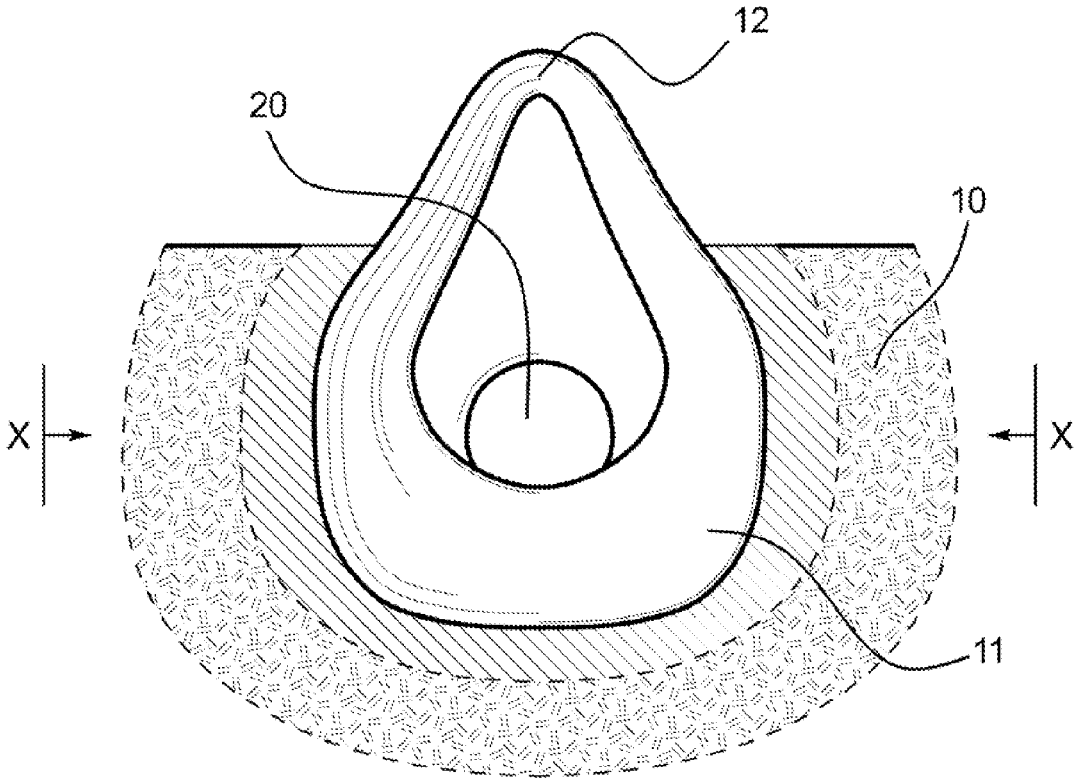
FIG. 1 is plan view of a respirator according to the principles of the present invention.

Referring first to FIG. 1, an example of a respirator according to the invention includes a face piece 11 is a half-face piece. The face piece 11 is shaped to cover the mouth and nose of a wearer and has a nosepiece 12 shaped to fit over the wearer's nose. A filter canister 10 is affixed to the face piece and is filled with a filtering medium 13. The filter canister 10 is in the form of a hollow section, which "fits" around the half-face piece 11. To prevent blocking of the wearer's field of vision filter canister 10 does not fit around nosepiece 12. The filter canister 10 is generally of a U-shape, half-circle shape, or other shape that provides a recess into which the face piece is disposed.

Figure 2:
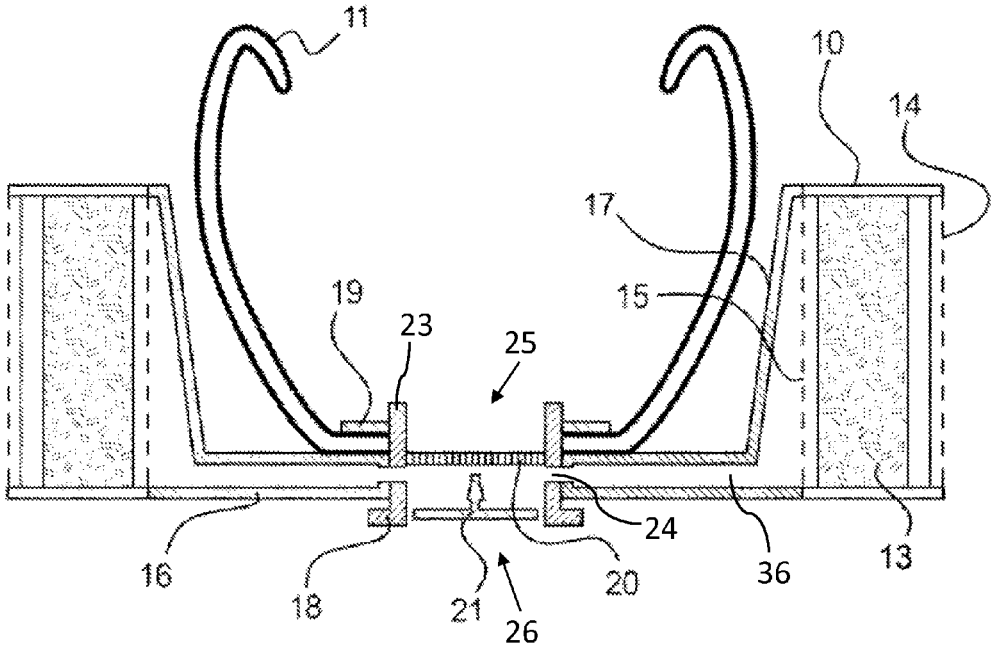
FIG. 2 is an elevation view of the respirator of FIG. 1.

FIG. 2 illustrates the section through filter canister 10 and face piece 11 at axis XX in FIG. 1. The filter canister 10 is fitted with perforated inlet surface 14 and outlet surface 15, which form respectively the inlet and outlet of the filter. That is, on inhalation air is drawing in through the inlet surface 14, through filter medium 13 and exits through outlet surface 15. The filter canister 10 is fitted with a bottom plate 16 and a top plate 17. The bottom and top plates 16 and 17 are so configured as to form a gas-tight volume with the filter canister 10. The top plate 17 is configured s shown to form a "hollow" in which face piece 11 sits and to ensure that airflow through the surface 15 is not restricted. In use, the face piece 11 is sealed to the top plate 17 by the hollow assembly 18, which passes through the bottom plate 16, the face piece 11, and the top plate 17 and is securely retained by a locking device 19. The hollow assembly 18 is fitted with ports 20 and an outlet valve 21. The hollow assembly 18 may comprise a substantially tubular body comprising at least one wall 23 having at least one inlet 24. The at least one wall 23 may be oriented between a first end 25 and a second end 26. On inhalation, filtered air from the filter canister 10 passes through an air flow channel element 36, through the at least one inlet 24, through the ports 20 and through the first end 25 in the hollow assembly 18 into the face piece 11 and into the wearer's lungs. On exhalation, the exhaled air passes from the first end 25 to the second end 26 through the hollow assembly 18 and the outlet valve 21, and to the atmosphere. Optionally, the ports 20 may be fitted with one or more inhalation valves, not herein shown.

To maximize the efficiency of the seal between face piece 11 and the wearer's face, the filter canister 10 and the top plate 17 can be configured as shown in FIG. 2 where the top plate 10 allows the maximum possible flexibility of the face piece 11.

In practice, a useful proportion of the depth of face piece 11, and thus parts of the wearer's face, are mainly located within the depth of the filter canister 10, thereby forming a low profile respirator, which reduces the disadvantages of a conventional respirator as noted above.

As the effective cross-sectional area for air flow is the product of the circumference of the surface 15 and the height of the surface 15, a large air flow area is available, which permits a low inhalation resistance. If a larger air flow area is required, the filter canister 10 can be "corrugated" in the plane of the plan shown in FIG. 1 and/or can be increased in depth and/or can be spaced further out from the face piece 11.

Where it is required that Filter Canister 10 and Face piece 11 are used in conjunction with a hood, such that Filter Canister 10 is located outside the hood and Face piece 11 is located inside the hood, it could be arranged that part of the hood lies between Face piece 11 and Top Plate 17 and is sealed between Face piece 11 and Top Plate 18 and securely retained by Hollow Assembly 18 and Locking Device 19.

Where the filter canister 10 is not to be used with a hood, the surface of the face piece 11 which seals to the wearer's face can be formed by a suitable material, such as a closed cell plastics or rubber foam incorporated with or on the top plate 17. A strap or other affixing means may be provided to permit the user to wear the respirator in a hands free mode. A hood may also be provided to cover the wearer's head, and the respirator can be affixed to the hood, either permanently or removably. It is also possible that the respirator may operate by simply being held to the user's mouth and nose by the user's hands, and thereby eliminating the need for a hood, strap or other affixing means.

Thus, there is shown and described a respiratory protective device in which the face piece 11 is located within the volume of filter canister 10. The filter canister 10 can be in the form of a hollow section or sections which fit around all or part of the face piece 11. Contaminated air that has been purified in filter canister 10 is ducted in an airtight manner through the hollow assembly 18 into the face piece 11.

Figure 3:
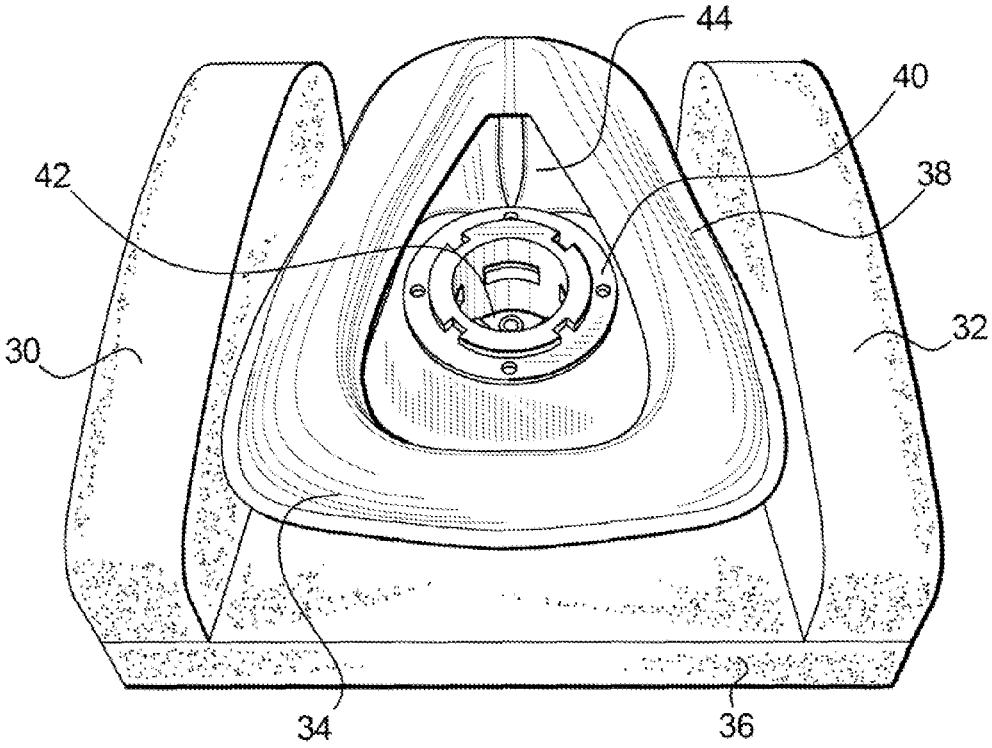
FIG. 3 is a photograph in a top front view of a prototype of the respirator according to a second embodiment.

Turning now to FIG. 3, a prototype of an embodiment of the respirator is provided that has filter elements 30 and 32 disposed laterally of a face piece 34. The filter elements 30 and 32 are connected to the face piece 34 through a flow channel element 36 that in an actual device is hollow and provides air flow between filter media held in the filter elements and the face piece 34 to enable the wearer to breath filtered air. The face piece 34 has an elastomeric body 38 that fits onto the nose and mouth of the wearer and an inlet/outlet channel 40 that connects to the flow channel element 36 for the intake of filtered air and to an exhalation valve 42 through which exhaled air is exhausted to the atmosphere. The relative dimensions of the prototype are approximate and can be varied based on material and construction. In a preferred construction, the device is pocket size so that it can be carried for use when needed. Portions thereof may be scaled down to accommodate such a compact construction.

Figure 4:
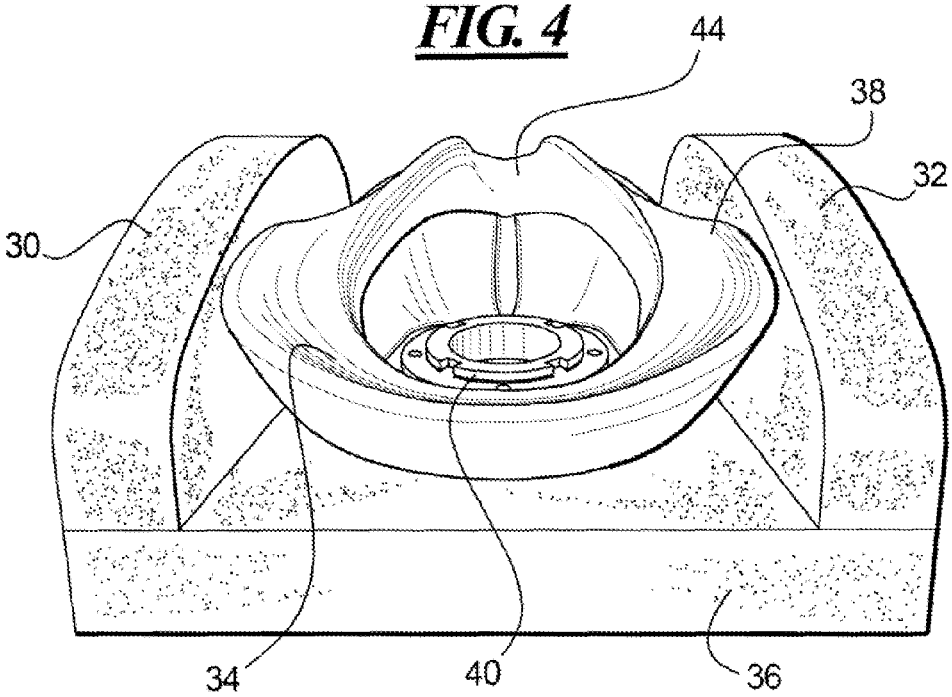
FIG. 4 is a photograph of the prototype of FIG. 3 generally from the front.

With reference to FIG. 4, the filter elements 30 and 32 extend toward the wearer's face so as to provide a low profile and keep the center of gravity of the device close to the wearer's face. The height of the filter elements 30 and 32 provide the surface area necessary for easy breathing by the wearer without the need for the lower portion of the U-shaped filter of FIG. 1. The face piece 34 includes a relatively rigid base element 44 supporting the elastomeric body 38.

Figure 5:
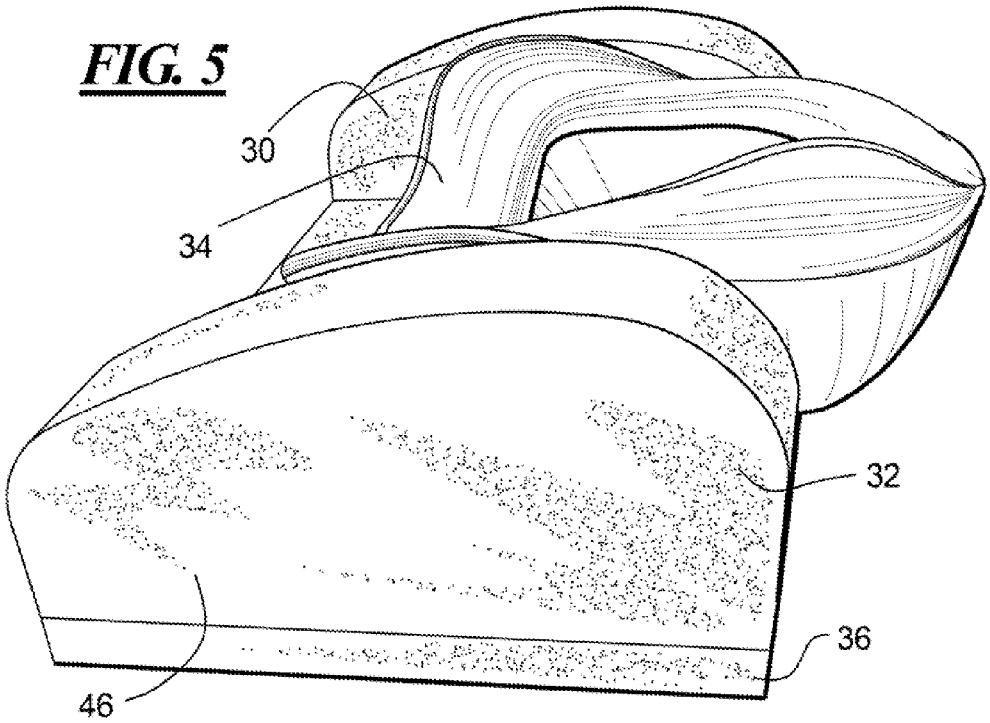
FIG. 5 is a photograph of the prototype of FIG. 3 generally from the side.

FIG. 5 shows that the filter elements 30 and 32 provide a relatively large surface area 46 for the filter media. The filter elements 30 and 32 are shaped for comfort while the respirator is being worn and for compactness during storage.

Figure 6:
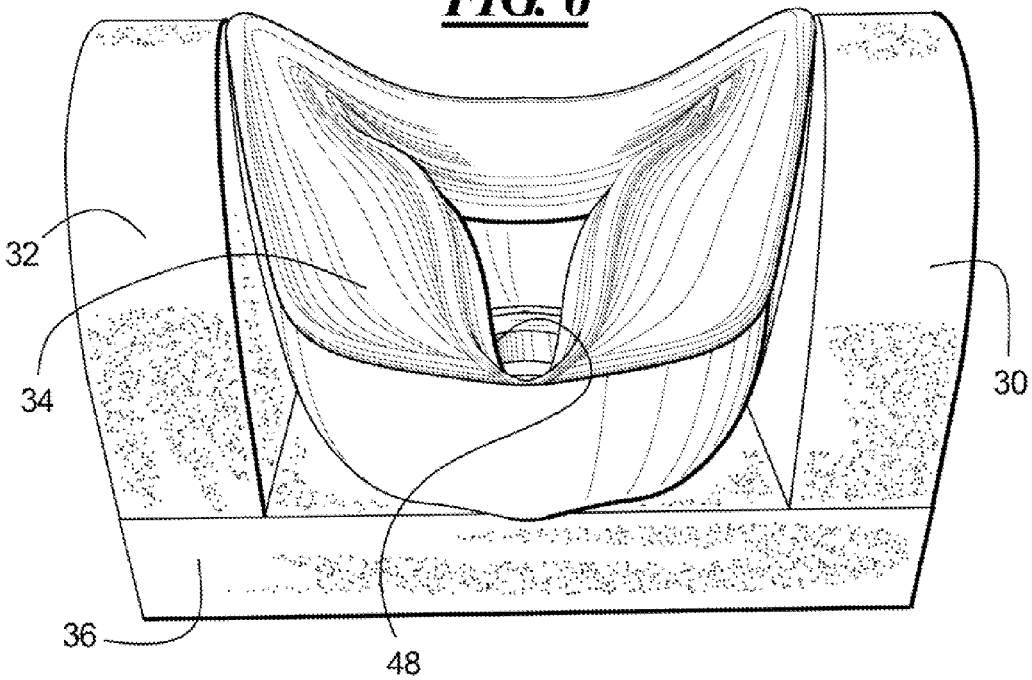
FIG. 6 is a photograph of the prototype of FIG. 3 generally from the back.

In FIG. 6, the face piece 34 has a nose piece 48 that fits closely onto a wearer's nose to ensure that the wearer is breathing filtered air.

Figure 7:
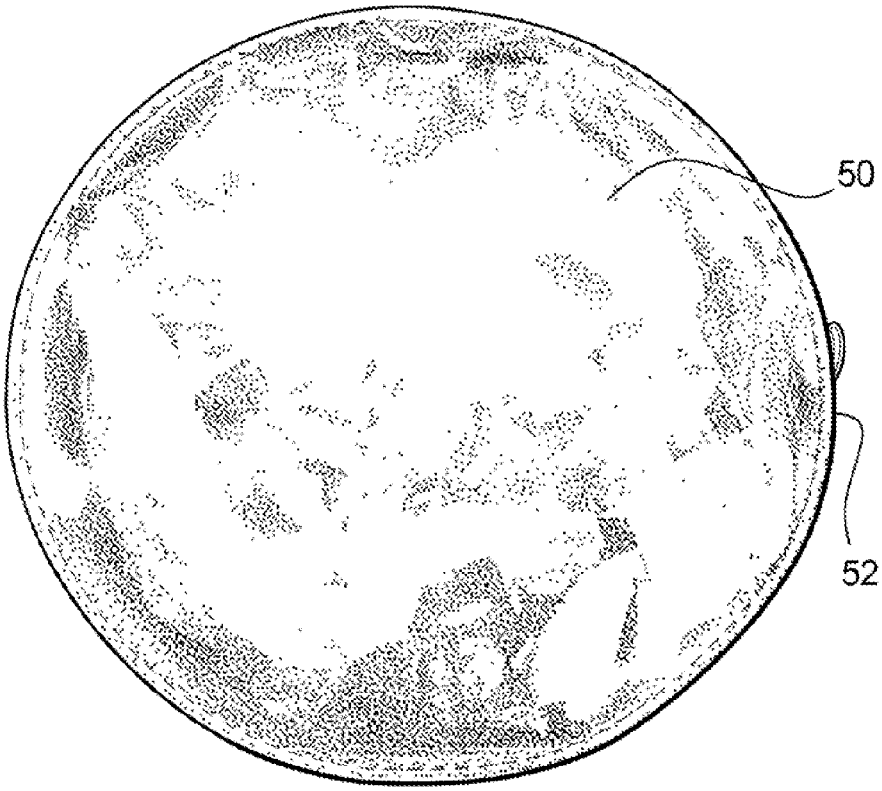
FIGS. 7, 8, and 9 show an embodiment of the present respirator enclosed in packaging for storage and carrying, in plan, elevation and an alternative packing, respectively.
Figure 8:
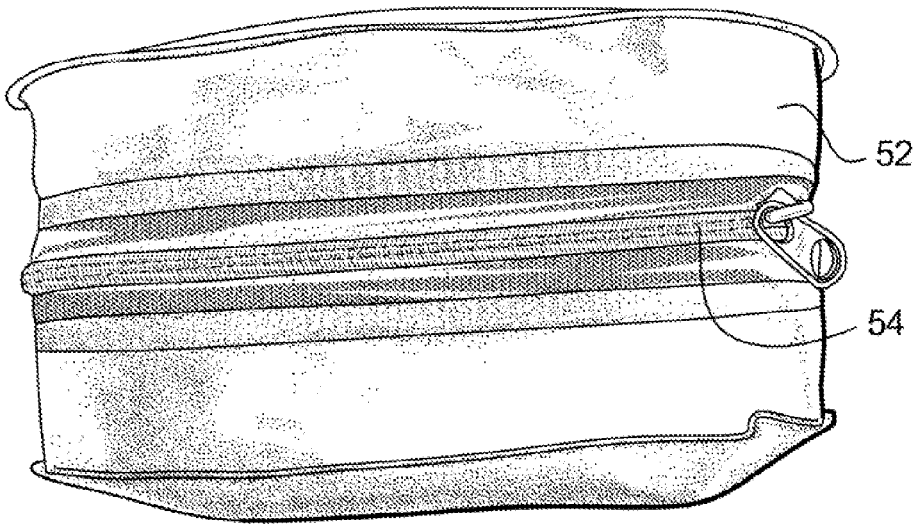
Figure 9:
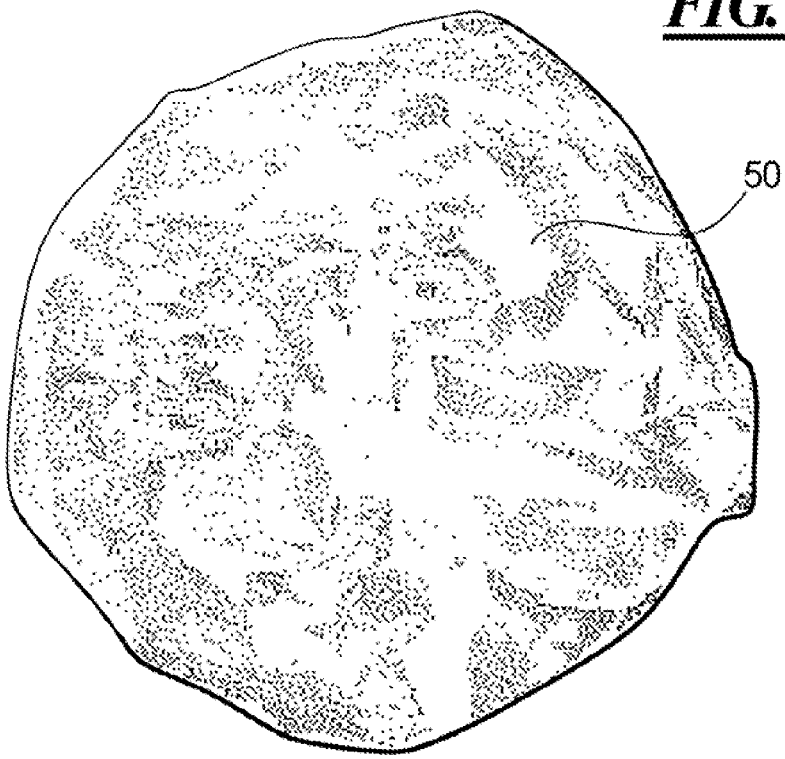

The present device can be provided as a separate respirator body or in combination with a hood. The hood can be worn while escaping from a fire or other emergency situation where there is a risk of breathing the air. Packaging for the escape hood using the present device is shown in FIGS. 7, 8 and 9. The hood 50 is packaged in a pouch 52 that has a zipper 54 or other closure to enable the user ready access to the hood. The package 52 is small and compact for easy storage and carrying. FIG. 9 is a top view of the hood having the present respirator mounted therein. The hood which has a clear face portion may be donned during an emergency situation and provide the wearer with filtered air and protection from smoke, etc. during the emergency.

Figure 10:
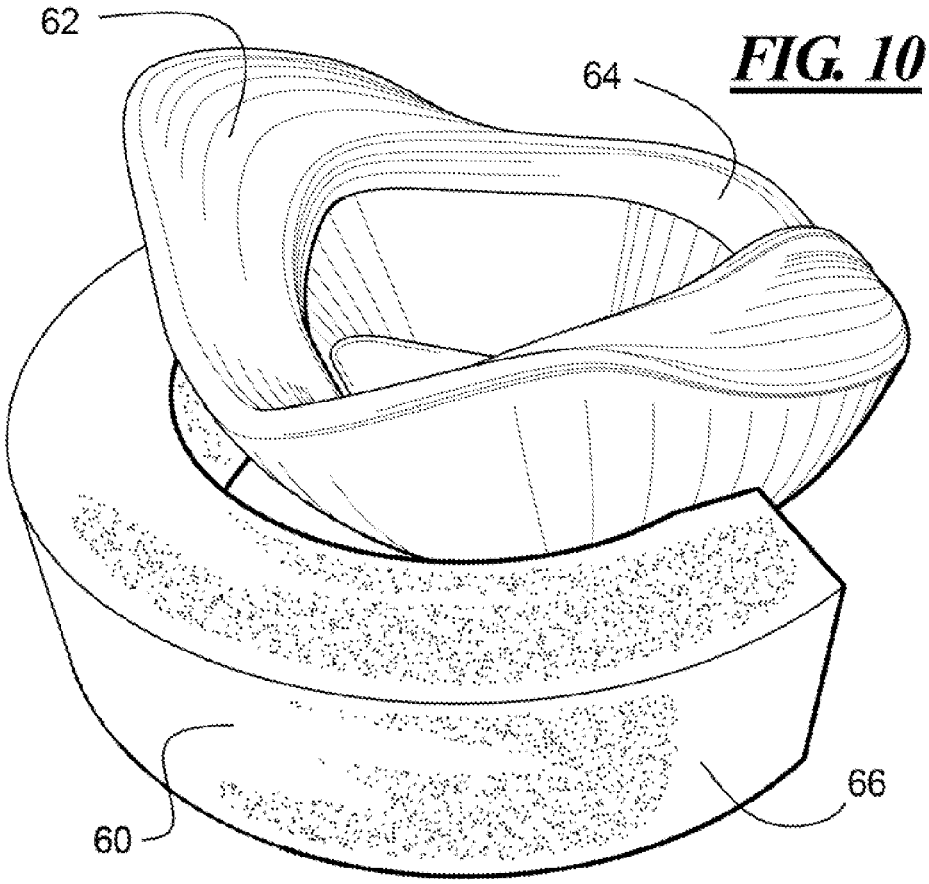
FIG. 10 is a photograph of a prototype of a further embodiment, generally from the side.

In FIG. 10, the filter element 60 is U-shaped, or more precisely, horseshoe shaped. The hollow area within the filter element has the face piece 62 disposed therein to provide a low profile overall construction. The face piece 62 is shown with a soft elastomeric seal member 64 that fits onto a wearer's face. A compact construction of the face piece may be provided so that the entire device has an overall dimension of little more than the filter element 60 itself. The outer surface 66 of the filter element 60 provides the air intake surface for the filter, and the U-shaped body contains the filter media that filters the air being breathed in by the wearer. Like the other embodiments, an exhale valve is disposed at the front of the face piece 62.

Figure 11:
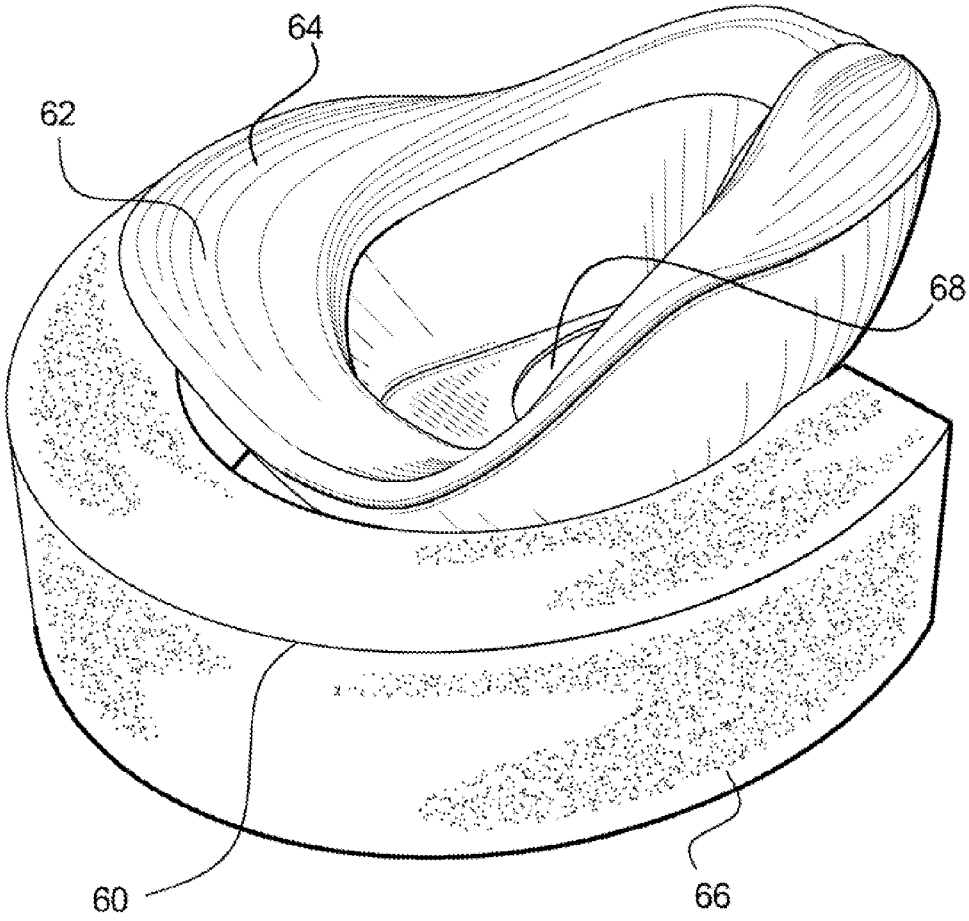
FIG. 11 is a photograph of the prototype of FIG. 10, generally from the top.

FIG. 11 shows the location of the exhale valve 68. The filter element 60 forms a partially encircling structure around the wearer's mouth. A recess may be provided to give clearance for the wearer's chin, although such a recess is not shown. The filter element 60 of the preferred embodiment does not extend around the wearer's nose so as to not block the wearer's field of vision and provide better visibility, particularly in the emergency situation in which the present device is likely to be worn.

Following is a discussion of concepts and alternatives encompassed within this invention and which may be embodied in various alternative constructions.

Design Concept and Capabilities of Low Profile Filter Respirator

The present invention provides an escape hood that is designed as a low-profile pocket-size escape respirator, small enough and sufficiently light-weight to be easily carried by a civilian in a purse or pocket and donned within 30 seconds, providing the user with sufficient protection to escape safely from an emergency situation.

This mask is an individual protection device intended to provide respiratory and ocular protection against smoke, toxic industrial chemicals, and overt chemical or biological attack. The mask is for short duration use to escape an area of known or suspected contamination. The mask is designed to provide protection for a general population of adults who may wear eyeglasses, have beards, long hair or other characteristics, which may preclude use of military-style masks. The escape mask is packaged for storage until time of use with explicit and easy to understand instructions. A low cost training version of the mask with distinct markings stating that it is a "Training Mask" and that it provides "no protection" is included to familiarize the wearers with the donning procedures.

The hood provides at least 15 minutes of respiratory and ocular protection against smoke and a variety of chemical, biological and industrial agents. The mask is not intended for use in a fire characterized by low oxygen and high carbon monoxide atmosphere.

In its sealed packaging, the hood can be easily carried in a pocket and can be put on within 30 seconds.

Design Considerations:

The Escape Hood is the low-profile product of extensive R & D, laboratory- and field-testing and trade-off analyses between practical device weight and size versus protection capabilities in real-life emergency situations.

Assessments of past terrorist incidents, other emergency situations coupled with extensive use of focus groups, enabled the developer to determine the practical requirements for the low profile filter respirator.

These included:

Basic technical requirements—the escape hood must be instantly available when required: therefore devices must have low bulk and weight and be conveniently carried on the person or stored in necessary numbers close to likely-use locations;

Performance requirements—meets defined intended use situations, necessary wear durations, and quantified likely health hazards;

Intended use—non-military/non-industrial personnel: escape from terrorist, fire, industrial accident; etc.

Necessary wear duration—15 minutes, sufficient to enable a significant proportion of uninjured wearers to escape to clean air in most intended situations;

Outline requirement—meets European standard and assumes adequate protection for at least 85% of wearers in predicted situations;

Likely health hazards—fire, industrial accidents/spillage and terrorist incidents;

Design requirement—a useful device to protect eyes and lungs against particulates, inorganic and organic substances;

Meets Immediately Dangerous to Life and Health (IDLH) exposure requirements—"to ensure that the worker can escape from a given environment . . . " (NIOSH 1997);

CO protection: possibly not necessary for a device intended for 85% of use in situations involving children and 95% of use situations involving adults. Cumulative exposure of 4,500 ppm over 15 minute period;

Caveats on current international standards vs. practical use:

Standard capacity tests for gas and vapor filters tend to specify substantially higher capacities than are likely to be required in real-life escape situations. For example, EN 403 specifies an HCl capacity of at least 15 minutes against 1,000 ppm at a constant flow rate of 30 liters/min. That is, a capacity of 6.75 liters of HCl. From Jankovic et al (1991) the highest HCl concentration reported in a fire situation was 200 ppm and on 95% of situations was about 50 ppm, i.e. on 95% of real-life situations a capacity of 0.34 liters of HCl would be adequate. That is, over a 15 minute period EN 403 would specify a filter about 20 times larger than required.

Standard gas and vapor filter tests also tend to be carried out at substantially higher challenge concentrations than are likely to be experienced in real life situations: essentially to shorten testing times for conventional filters and so minimize testing costs. For example, as noted above, EN 403 requires that filter capacity against HCl be tested at 1,000 ppm as against a 95 percentile real-life challenge concentration of 50 ppm. Such high standard test concentrations are likely to have three effects: (1) filter capacity & (2) filter activity: depending on the mechanism(s) by which the filter functions, filter capacity and filter activity may both be higher at the laboratory challenge concentrations than in real-life situations, e.g. see Nelson et al (1985), i.e. filter performance may be overestimated; and, (3) any effects of leakage and channeling within the filter may be over-emphasized, e.g. a 1% leakage rate in a challenge concentration of 1000 ppm will give an apparent "breakthrough" of 10 ppm, and the filter will therefore fail to meet the criterion of <5 ppm breakthrough and may so prevent the provision of an effective filter, whereas a similar leakage at a challenge concentration of 50 ppm will be 0.5 ppm and therefore be substantially below the breakthrough criterion of 5 ppm.

Therefore, it is considered that compliance with the arbitrary requirements of current Standards is likely to result in devices which are too heavy and too bulky to be suitable for many non-industrial self-rescue use situations.

It is therefore considered that realistic standards should be developed for low-profile devices intended for non-industrial self-rescue situations.

Operational Capabilities: Low Profile Filter Respirator

A pocket-sized escape hood.

Designed to protect respiratory organs, eyes and facial skin against CBRN (Chemical, Biological, Radiological, Nuclear) agents to European Union and US NIOSH Standard—25 minutes escape protection.

Low-volume and lightweight.

Short donning time (less than 30 seconds).

Flame & heat resistant at temperatures up to 800° C.

Long shelf-life.

Escape Hood package comprises: Escape Respirator; Training Respirator; Instructional Video; Instruction Leaflet.

Technical Specifications:

The Escape Hood comprises three principal elements:

A Hood made from transparent polyimide film that provides the advantages of clear all-round visibility, high mechanical strength, long storage-life, combustion resistance and impermeability to harmful chemical/biological substances (gas or liquid).

An Aerosol Filter made from polymeric material on a base of PVC fibers.

A Vapor and Gas adsorption element comprising a universal sorbing agent on a base of activated charcoal with catalytic and chemisorbant agents.

Weight with carrying pouch: max 250 g.

Protective Capability:

The tables below outline the current protective capabilities of the Low Profile Filter Respirator.

TABLE 1

| Practical escape protection against chemicals with terrorism potential identified by US Homeland Security: | |
|---|---|
| 1. | Acrylonitrile |
| 2. | Methyl bromide |
| 3. | Methyl mercaptan |
| 4. | Ethyl mercaptan |
| 5. | Ethylenimine |
| 6. | Chloropicrin |
| 7. | Chlorine |
| 8. | Hydrogen sulphide |
| 9. | Carbon disulphide |
| 10. | Hydrocyanic acid |
| 11. | Phosgene |
| 12. | Sulphur dioxide |
| 13. | Hydrogen chloride |
| 14. | Hydrogen bromide |
| 15. | Hydrogen fluoride |
| 16. | Ammonia |
| 17. | Dimethylamine |
| 18. | Trimethylamine |
| 19. | Acrolein |
| 20. | Chloride benzene |
| 21. | Dimethylaniline |
| 22. | Hydrogen cyanide |
| 23. | Carbon monoxide (CO) |
| 24. | Carbon bisulphide |
| 25. | Toluene |
| 26. | Chlorpicrin |
| 27. | Cyanide chloride |

TABLE 2

| Practical escape protection against other toxic industrial chemicals: | |
|---|---|
| 28. | Acetonitrile |
| 29. | Benzene and its derivatives |
| 30. | Methyl acrylate |
| 31. | Ethylene sulphide |
| 32. | Cyclohexane |
| 33. | Organophosphorous substances; |
| 34. | Arseniureted hydrogen |
| 35. | Aniline |
| 36. | Dimethylformamide |
| 37. | Dichloroethane |
| 38. | Isobutylene bromuro |
| 39. | Acetic acid |
| 40. | 4-chlorine silicone |
| 41. | Xilene |
| 42. | Cyclohexane Chloride |

Field of View:

The Low Profile Filter Respirator aims for a Visual Field Score of 100 (NIOSH VFS standard: ≥70).

Prototype Escape Hood Packaging

Devices for self-escape may be worn by untrained wearers in stressful situations, it is therefore essential that factors such as breathing resistance and discomfort are minimized as far as possible.

Even for cutting-edge technology, to minimize weight, bulk and breathing resistance, it is necessary to ensure that the technical requirements are not over-specified.

The present device is for use, for example, in fires, industrial accidents, and terrorist incidents. An escape duration of 15 minutes should be adequate to enable escape or move to a clean air base in most fire situations. The same period should also allow wearers to move away from, or upwind from, or out of the plume formed by, industrial spillages and terrorist incidents. The present device protect the eyes and the lungs against particulates and organic and inorganic substances.

Although other modifications and changes may be suggested by those skilled in the art, it is the intention of the inventors to embody within the patent warranted hereon all changes and modifications as reasonably and properly come within the scope of their contribution to the art.

I claim:

1. A respirator apparatus for wear by a wearer during an emergency situation, comprising:

a face piece having a body shaped to fit onto at least the mouth and nose of the wearer, and a seal portion on the body for a sealing engagement with the wearer's face;

a generally U-shaped filter element including a filter media, the filter element defining a structure having a hollow section therein, and the face piece being disposed in the hollow section, such that the filter element wraps around the face piece;

wherein the filter element comprises a bottom plate and a top plate, the face piece being sealed to the top plate by a hollow assembly which passes through the bottom plate, the face piece and the top plate, wherein the hollow assembly comprises a substantially tubular body having at least one wall oriented between a first end and a second end, wherein the at least one wall comprises at least one inlet, and wherein an exhaust valve is oriented at the second end; and an air flow channel element connecting the filter element to the face piece in fluid communication, and the exhaust valve being in fluid connection with the air flow channel element-so that a wearer inhaling draws air through the filter media in the filter element, through the air flow channel element, through the at least one inlet in the hollow assembly, through the first end of the hollow assembly, and through the face piece, and on exhalation, exhaled air passes through the hollow assembly from the first end to the second end and through the exhaust valve to the atmosphere.

2. The respirator apparatus of claim 1, wherein the filter element is formed in a first part and a second part, the first part and the second part being disposed on either side of the face piece.

3. The respirator apparatus of claim 1, wherein the filter element further comprises an outlet surface, and the face piece is wholly or partly recessed within the filter element and is connected to the outlet surface of the filter element in an airtight manner.

4. The respirator apparatus of claim 1, wherein the face piece is formed as one of a quarter mask and a half mask device.

* * * * *